US007828087B2

(12) United States Patent
Vora

(10) Patent No.: US 7,828,087 B2
(45) Date of Patent: Nov. 9, 2010

(54) ROCKET RIG DRILLING APPARATUS

(76) Inventor: Theodore Chen Vora, 5237 Mimosa Bellaire, Bellaire, TX (US) 77401

( * ) Notice: Subject to any disclaimer, the term of this patent is extended or adjusted under 35 U.S.C. 154(b) by 146 days.

(21) Appl. No.: 12/278,755

(22) PCT Filed: Aug. 16, 2006

(86) PCT No.: PCT/US2006/032035

§ 371 (c)(1),
(2), (4) Date: Aug. 7, 2008

(87) PCT Pub. No.: WO2007/022300

PCT Pub. Date: Feb. 22, 2007

(65) Prior Publication Data

US 2009/0321135 A1 Dec. 31, 2009

Related U.S. Application Data

(60) Provisional application No. 60/708,478, filed on Aug. 16, 2005, provisional application No. 60/771,561, filed on Feb. 8, 2006.

(51) Int. Cl.
*E21B 15/00* (2006.01)
*E04H 12/34* (2006.01)

(52) U.S. Cl. ..... 175/220; 175/162; 175/203; 52/116

(58) Field of Classification Search ..... 52/116; 175/162, 203, 220
See application file for complete search history.

(56) References Cited

U.S. PATENT DOCUMENTS 3,802,137 A * 4/1974 Armstrong ..... 52/118
4,221,088 A * 9/1980 Patterson ..... 52/116
4,578,911 A * 4/1986 Hashimoto ..... 52/120

* cited by examiner

*Primary Examiner*—Giovanna C Wright
(74) *Attorney, Agent, or Firm*—Winstead PC

(57) ABSTRACT

A well drilling apparatus includes multiple, transportable, modular, pre-assembled sections which include a substructure and multiple mast sections. These pre-assembled sections allow for a quicker complete rig-up of the well drilling apparatus at ground level in a horizontal direction, without the use of a crane. Once the assembly has been completed at ground level, the mast is raised to its vertical operating position via mechanisms for raising and lowering dog tails. During transport, the guide rails are built-in to the mast sections and the crown block is attached to the traveling block, thereby facilitating the rigging-up process. The mast may be lowered after the drilling operation has been accomplished without interfering with any blow-out preventer devices that may have been placed on the wellhead while the structure was at its raised operational level.

23 Claims, 8 Drawing Sheets

ROCKET RIG DRILLING APPARATUS

This application claims the benefit of both U.S. Provisional Application No. 60/708,478, filed Aug. 16, 2005, and U.S. Provisional Application No. 60/771,561, filed Feb. 8, 2006.

FIELD OF THE INVENTION

The present invention relates generally to a well drilling apparatus and more particularly to a well drilling apparatus that can be entirely assembled horizontally at ground level and raised to a vertical operating position for drilling oil and gas wells or the like. The well drilling apparatus is modular and can be relocated easily from one site to another without much disassembling.

BACKGROUND

For many drilling operations, it is necessary to drill relatively deep wells, thereby requiring longer drill strings and larger traveling blocks. These longer drill strings and larger traveling blocks, in turn, require the use of greater mast heights. To accommodate this requirement, usually mounted drawworks and other drilling equipment are placed on an elevated equipment floor, which is elevated above ground level so as to provide clearance for a relatively tall blow-out prevention apparatus.

In order to accommodate the need for an elevated equipment floor, numerous structures have evolved, but have proven to be deficient in many ways. Most particularly, prior art elevated floor structures have proven to be relatively complex and time consuming to assemble at the drilling site, and, for this reason, are expensive to assemble and use. In many such prior art structures, the elevated floor and then the mast must be constructed and connected together in, essentially, a piece-by-piece operation, very often requiring the use of a crane which thereby increases the expense. Further, when structures are finally erected, the rigging or outfitting of them must be carried out at the elevated level further requiring the use of a crane and additionally complicating the rigging process.

Examples of such prior art structures include those which have a relatively low substructure supporting a tall mast, and the elevated equipment floor is inserted in the mast at a given distance above ground level. Usually, an additional elevated support structure is provided for the drawworks. In such an arrangement, the rigging operation must be carried out at an elevated level requiring the use of cranes and, prior to rigging being able to occur, it is necessary that separate raising operations be carried out for the various portions of the equipment floor. This arrangement, therefore, produces a complex arrangement for constructing the elevated floor, as well as an expensive rigging operation.

It is a desire of the present invention to provide a well drilling apparatus for drilling oil and gas wells or the like, in which the component parts can be assembled horizontally at ground level and then raised to a vertical position where they are operational and in which all of the raising operations can be accomplished with power supplied by a pair of built-in hydraulically driven winches or a pair of built-in dog tail spoolers. It is another desire of the present invention to provide a well drilling apparatus that is modular and can be easily relocated from one site to another without much disassembling.

BRIEF SUMMARY OF THE INVENTION

The present invention is a well drilling apparatus that is modular, easy to rig up and down and easy to transport. This well drilling apparatus has a pre-assembled modular substructure, at least one pre-assembled modular mast intermediate section, and a pre-assembled modular top mast section, which includes a traveling block and a crown block as a unit. The substructure comprises a mast starter section which has its front legs pivotally mounted to the substructure at the front leg mounts, an elevatable drill floor which is pivotally connected to the substructure via supporting legs, at least one dog tail for pivotally raising the assembled mast to its vertical operating position, and a mast assembly raising system. The mast intermediate sections and the top mast section are assembled at ground level, without requiring the use of a crane. Once the mast is assembled at ground level, the mast assembly raising system raises the mast to its vertical operating position while simultaneously raising the elevatable drill floor. The elevatable drill floor remains in a substantially horizontal position during the entire raising or lowering process.

The mast assembly raising system, according to one embodiment of the present invention, includes a dog tail spooler located at the front end of the substructure, a first dog tail sheave located near the rear end of the substructure, a second dog tail sheave located at the top of the dog tail, a first sling line anchor point also located at the top of the dog tail, and a second sling line anchor point located along the length of the mast intermediate section. A dog tail line connects the dog tail spooler to the second dog tail sheave via the first dog tail sheave. At least one sling line is used to connect the first sling line anchor point to the second sling line anchor point.

Once the well drilling apparatus has been assembled in its horizontal position, the dog tail is first raised to its vertical position. The dog tail spooler is then activated so that the dog tail is lowered back to its horizontal position. At the same time, the mast is raised via the at least one sling line. Once the mast is in its fully vertical operating position, the equipment is secured by installing a rear leg drill floor pin and a rear leg pin.

In an alternative embodiment, the mast assembly raising system utilizes a hydraulic cylinder, a hydraulic arm and a transitional pulling sheave, in lieu of the dog tail spooler. This mechanism operates under the same principle as the previous embodiment, except that the transitional pulling sheave moves back and forth along the length of the substructure.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following description of a specific embodiment of the invention, when read in conjunction with the accompanying drawings, wherein.

DETAILED DESCRIPTION

Figure 1:
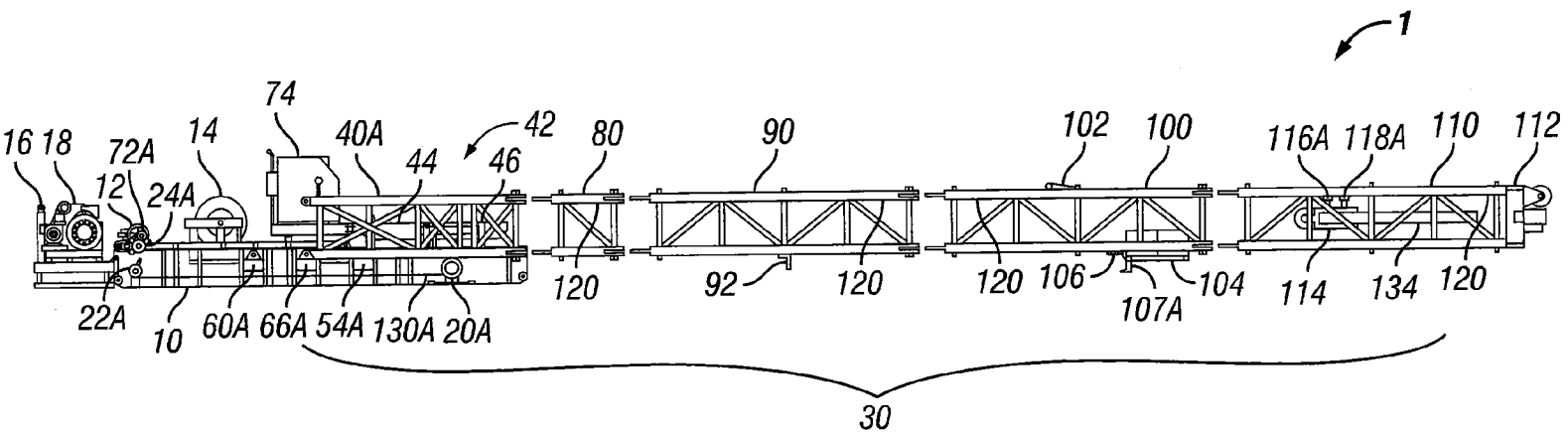
FIG. 1 illustrates a driller side elevation of various transportable pre-assembled modular sections of a well drilling apparatus in accordance with one embodiment of the present invention.

The following discussion is presented to enable a person skilled in the art to make and use the invention. The general principles described herein may be applied to embodiments and applications other than those detailed below without departing from the spirit and scope of the present invention as defined by the appended claims. The present invention is not intended to be limited to the embodiments shown, but is to be accorded the widest scope consistent with the principles and features disclosed herein.

As such, those skilled in the art will appreciate that the conception, upon which this disclosure is based, may readily be utilized as a basis for the designing of other structures, methods, and devices for carrying out the several purposes of the present invention. It is important, therefore, that the claims be regarded as including such equivalent constructions insofar as they do not depart from the spirit and scope of the present invention.

Referring to the drawings, it should be noted that the various parts have been numbered with "a" on the driller's side while parts on the opposite side of the apparatus, which may or may not be shown, is numbered with a "b". Sometimes, a part may be numbered with a "c" on the driller's side, in which case, on the opposite side of the apparatus, there is a part, which may or may not be shown, that is numbered with a "d". In most instances, parts will be numbered and shown only on the driller's side, it being recognized by the reader that the respective part on the opposite side of the apparatus referred to in the description is merely a mirror image of the part shown in the drawings.

Referring to FIG. 1, a driller side elevation of various transportable pre-assembled modular sections of a well drilling apparatus 1 in accordance with one embodiment of the present invention is shown. The first transportable assembled modular section is a substructure 10 which is transported in an assembled configuration. This section is designed to be transportation ready or within 12' width×12' height×60' length. The substructure's 10 base is boat-shaped, wherein there are two horizontal, parallel beams running lengthwise and connected to each other by two horizontal, parallel beams running widthwise. Although the substructure's 10 base is illustrated as having only two beams running lengthwise and two beams running widthwise, the substructure's 10 base may have more beams running lengthwise and more or less beams running widthwise without departing from the scope and spirit of the present invention.

From the view shown in FIG. 1, one can see that the substructure 10 includes a deadline anchor 12, a powered drill line spooler 14, a messenger line winch 16 and a drawworks 18, which are located on its rear portion, and a mast starter section 40*a*, an elevatable drill floor 42 comprising a rotary drill floor 44 being attached to a setback drill floor 46, a supporting leg 50*a* (FIG. 3), a supporting leg mount 54*a*, a rear leg mount 60*a*, a front leg mount 66*a*, a dog tail 70*a* (FIG. 2) having a second dog tail sheave 24*a* and a first sling line anchor point 72*a* attached to its top and a dog house and driller console 74, which are located on its front portion. The drawworks 18 for the drilling apparatus 1 is pre-assembled and rests on the rear side of the substructure 10, at truck bed height off the ground. The drawworks 18 is located at this height, whether the mast is in a raised position or in a lowered position, so as to allow a truck to be able to load and/or unload the drawworks 18 on or off the substructure 10.

The mast starter section 40*a* is initially positioned horizontally and is shown to be three sections long. Although this embodiment depicts the mast starter section 40*a* to be three sections long, one skilled in the art will understand that the mast starter section 40*a* can have more or less sections depending upon certain requirements without departing from the scope and spirit of the present invention. There is also a dog tail spooler 20*a* located very close to the substructure's 10 front portion and a first dog tail sheave 22*a* that is located close to the substructure's 10 rear portion. Although only one supporting leg 50*a* (FIG. 3), one supporting leg mount 54*a*, one rear leg mount 60*a*, one front leg mount 66*a*, one dog tail 70*a* (FIG. 2), one second dog tail sheave 24*a*, one first sling line anchor point 72*a*, one dog tail spooler 20*a* and one first dog tail sheave 22*a* is shown from the driller's side perspective, the same parts exist on the opposite side of the apparatus.

In the transported assembled state, the dog tail spooler 20*a* is in communication with the first dog tail sheave 22*a*, which in turn is in communication with the second dog tail sheave 24*a*, via a dog tail line 130*a*. Also, a front leg 64*a* (FIG. 3) of the mast starter section 40*a* is initially positioned horizontally and is pivotally attached to the front leg mount 66*a* via a front leg pin 68*a* (FIG. 3). The elevatable drill floor 42, which is attached to the dog house and driller console 74, is also positioned horizontally and is pivotally attached to the front leg 64*a* (FIG. 3) of the mast starter section 40*a*, via a front leg drill floor pin 48*a* (FIG. 3). Finally, the supporting leg 50*a* (FIG. 3) is initially positioned horizontally and is pivotally connected to the supporting leg mount 54*a* and the front portion of the elevatable drill floor 42 via a first supporting leg pin 52*a* (FIG. 3) and a second supporting leg pin 56*a* (FIG. 3), respectively. Also, the dog tail 70*a* (FIG. 2) is v-shaped, wherein the two legs of the "v" are pivotally attached to one of the horizontal, parallel beams running widthwise across the substructure's 10 base and is located approximately in the middle of the substructure's 10 base running lengthwise.

The other transportable pre-assembled modular sections include a mast strong back 80, a mast bottom section 90, a mast intermediate section 100 and a mast top section 110. The mast strong back 80 is shown to have one section. Although this embodiment depicts the mast strong back 80 to be one section long, one skilled in the art will understand that the mast strong back 80 can have more sections or eliminated entirely depending upon certain requirements without departing from the scope and spirit of the present invention. In this embodiment, the mast strong back 80 is designed to have a nominal hauling size of 12' width×8'-10" height×24' length. The mast strong back 80 also has a guide track 120 for a traveling block 114. This guide track 120 is removable so that the maximum traveling width of 12' can be maintained.

The mast bottom section 90 is shown to have four sections. Although this embodiment depicts the mast bottom section 90 to be four sections long, one skilled in the art will understand that the mast bottom section 90 can have more sections or less sections depending upon certain requirements without departing from the scope and spirit of the present invention. Also, a bellyboard 92 is attached about halfway along the mast bottom section's 90 front leg. Although this embodiment depicts the bellyboard 92 to be located halfway along the mast bottom section's 90 front leg, one skilled in the art will understand that the bellyboard 92 can be positioned anywhere along the mast 30 or eliminated entirely without departing from the scope and spirit of the present invention. In this embodiment, the mast bottom section 90 is designed to have a nominal hauling size of 10' width×8'-3" height×40' length. The mast bottom section 90 also has a guide track 120, which is built-in, for the traveling block 114.

The mast intermediate section 100 is shown to have four sections. Although this embodiment depicts the mast intermediate section 100 to be four sections long, one skilled in the art will understand that the mast intermediate section 100 can have more sections or less sections depending upon certain requirements without departing from the scope and spirit of the present invention. Also, a racking board 104 is pivotally attached to a racking board positioning block 107*a* via a racking board pin 106. The racking board positioning block 107*a* is positioned between the third and fourth sections along the mast intermediate section's 100 front leg. Although this embodiment depicts the racking board positioning block 107*a* to be located between the third and fourth sections along the mast intermediate section's 100 front leg, one skilled in the art will understand that the racking board positioning block 107*a* can be positioned anywhere along the mast 30. The racking board 104 is used for drill pipe storage and is in a foldable position. This embodiment also shows that a second sling line anchor point 102 is located about halfway along the mast intermediate section's 100 rear leg. Although the second sling line anchor point 102 is located about halfway along the mast intermediate section's 100 rear leg, one skilled in the art will understand that it may be located anywhere along the mast 30 without departing from the scope and spirit of the present invention. In this embodiment, it is preferable, but not necessary, that this second sling line anchor point 102 be located on the mast intermediate section 100 so that less force will be required to raise the mast 30 from the horizontal position to the vertical position. In this embodiment, the mast intermediate section 100 is designed to have a nominal hauling size of 10' width×8'-3" height×40' length. The mast intermediate section 100 also has a guide track 120, which is built-in, for the traveling block 114.

The mast top section 110 is shown to have four sections. Although this embodiment depicts the mast top section 110 to be four sections long, one skilled in the art will understand that the mast top section 110 can have more sections or less sections depending upon certain requirements without departing from the scope and spirit of the present invention. In this embodiment, the mast top section 110 is designed to have a nominal hauling size of 10' width×8'-3" height×40' length. The mast top section 110 also has a guide track 120, which is built-in, for the traveling block 114 and also accommodates the traveling block 114 and a crown block 112 during transport. The traveling block 114 is also supported to the mast top section 110 via a first traveling block tie down 116*a* and a second traveling block tie down 118*a* so that it remains stable during transport. The crown block 112, which consists of a fast-line sheave (not shown) and two deadline sheaves (not shown), is positioned at the head of the mast top section 110. Also during transport, the traveling block 114 and the crown block 112 are fully strung up via a messenger line 134. In this embodiment, the messenger line 134 is ⅜", but one skilled in the art will recognize that other thicknesses may be utilized without departing from the scope and spirit of the present invention.

Figure 2:
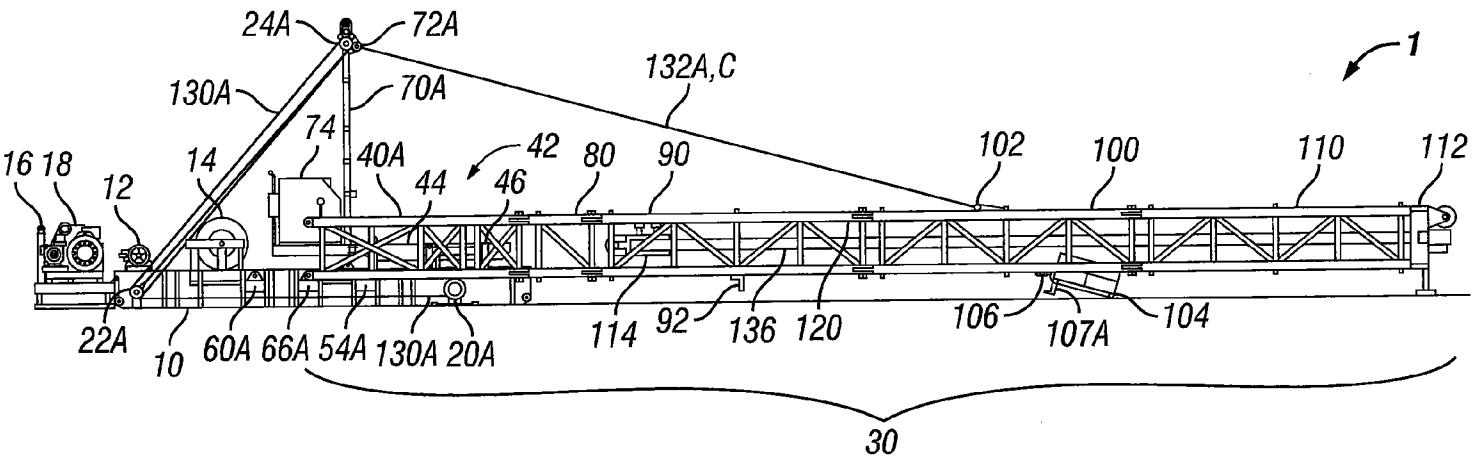
FIG. 2 illustrates a driller side elevation of the well drilling apparatus in accordance with one embodiment of the present invention in its horizontal field assembly position.
Figure 2B:
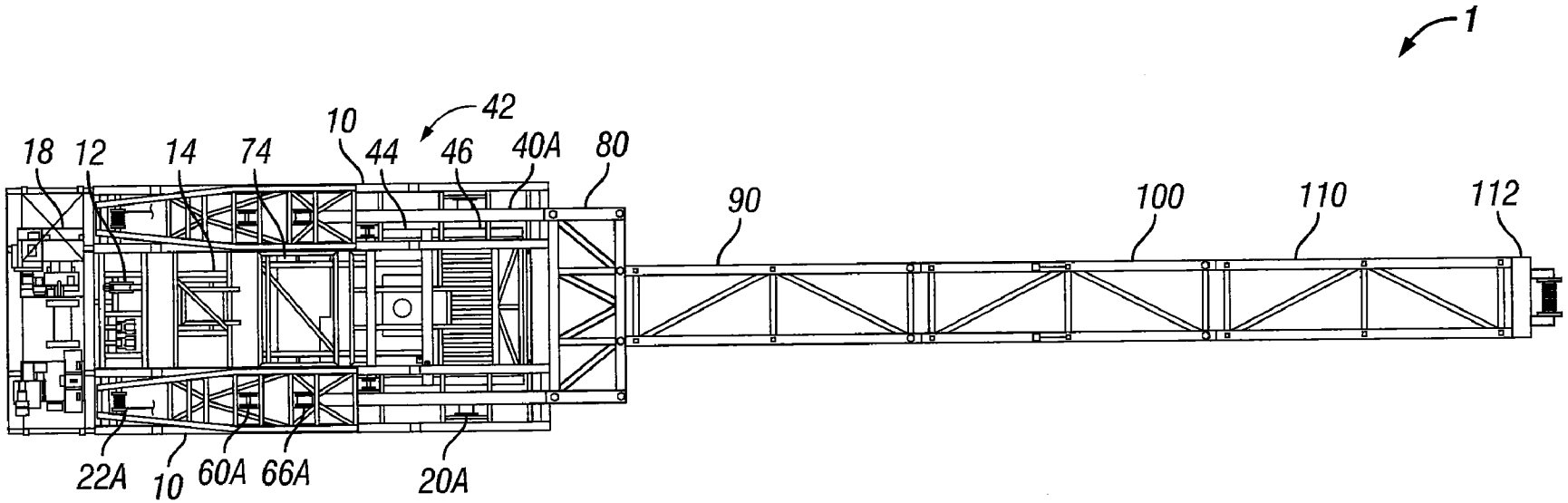
FIG. 2B illustrates an overhead plan view of the well drilling apparatus in accordance with one embodiment of the present invention in its horizontal field assembly position.
Figure 3:
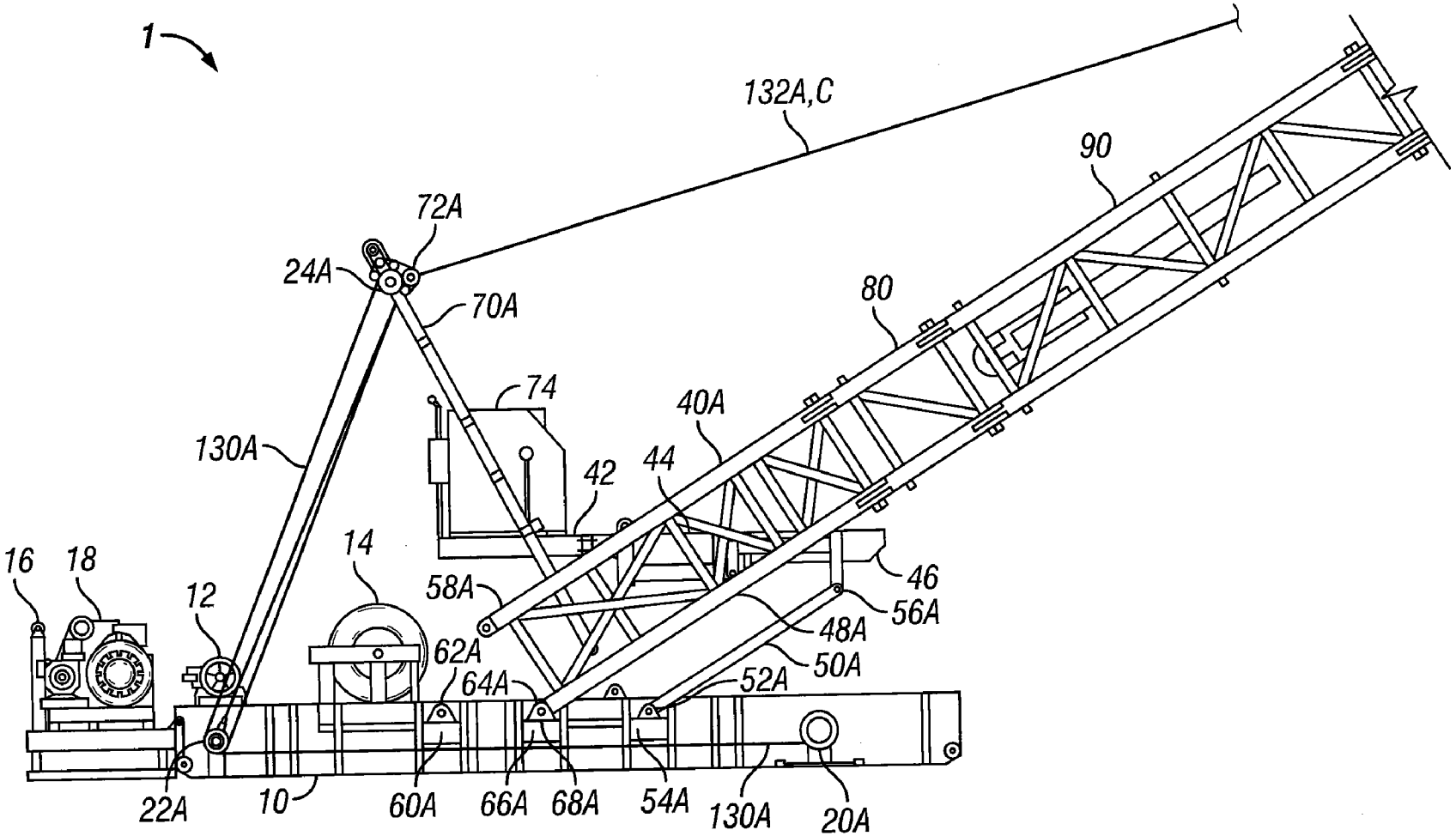
FIG. 3 illustrates a driller side elevation of the well drilling apparatus in accordance with one embodiment of the present invention wherein its mast and drill floor are in a position between its horizontal field assembly position and its vertical operating position.

Referring to FIG. 2, a driller side elevation of the well drilling apparatus 1 is shown in accordance with one embodiment of the present invention in its horizontal field assembly position. FIG. 2*p* shows an overhead plan view of the well drilling apparatus 1 shown in FIG. 2 and should be viewed in conjunction with FIG. 2. Once the pre-assembled sections of the well drilling apparatus 1 are transported to the desired site, the substructure 10 is first positioned in the proper location. The substructure 10 is placed on top of a diamond plated metal (not shown), which provides traction between the diamond plated metal and the substructure 10 and stability for the substructure 10 during operation. The bottom of the mast strong back 80 is then securely attached to the head of the mast starter section 40*a*, via pins. The bottom of the mast bottom section 90 is then securely attached to the head of the mast strong back 80, via pins. The bottom of the mast intermediate section 100 is then securely attached to the head of the mast bottom section 90, via pins. Finally, the bottom of the mast top section 110 is securely attached to the head of the mast intermediate section 100, also via pins. Although this embodiment uses pins to securely attach each of the sections to another section, one skilled in the art will recognize that other attachment methods, including screws, fasteners, rivets and other methods known in the art, can be used without departing from the scope and spirit of the present invention. In this embodiment, this entire structure can be assembled entirely at ground level using a forklift or a gin truck. The use of a crane is not required for assembling any part of the structure. Although this embodiment uses a forklift or a gin truck to assemble the entire structure at ground level, any apparatus known in the art may attach the sections at ground level without departing from the scope and spirit of the present invention.

Once the entire mast 30 is assembled horizontally along ground level, the dog tail 70*a* is raised to a vertical position. The dog tail spooler 20*a* is still in continuous communication with the first dog tail sheave 22*a*, which in turn is still in continuous communication with the second dog tail sheave 24*a*, via the dog tail line 130*a*. The dog tail line 130*a* travels from the dog tail spooler 20*a* and wraps around the first dog tail sheave 22*a*. The dog tail line 130*a* then continues and wraps around the second dog tail sheave 24*a*, which then returns back to and anchors onto the first dog tail sheave 22*a*. Although this embodiment illustrates that the dog tail line 130*a* anchor point is on the first dog tail sheave 22*a*, one of ordinary skill in the art will recognize that the dog tail line 130*a* anchor point can be located anywhere on the substructure 10 without departing from the scope and spirit of the present invention. Also, although only two dog tail sheaves, as seen from the driller's side perspective, are illustrated in this embodiment, more than two dog tail sheaves may be used without departing from the scope and spirit of the present invention.

A pair of sling lines 132*a*, 132*c* is securely attached at one end to the first sling line anchor point 72*a* and the other end to the second sling line anchor point 102. These sling lines 132*a*, 132*c* are secured tightly so as to keep the dog tail 70*a* in its upright position. These sling lines 132*a*, 132*c* are also used to raise the mast 30 to its vertical operating position. Although this embodiment illustrates a pair of sling lines 132*a*, 132*c*, one of ordinary skill in the art will recognize that the number of sling lines can be more or less without departing from the scope and spirit of the present invention.

To save on rigging time, a messenger line 134 (FIG. 1) is temporarily strung through the crown block 112 and traveling block 114 when the mast 30 is being transported. After the mast 30 has been assembled in the horizontal assembly position, a messenger line winch 16 is fastened to the deadline end of the messenger line 134 (FIG. 1) and a drill line 136, which is stored in the powered drill line spooler 14, is attached to the fast line end of the messenger line 134 (FIG. 1). The messenger line winch 16 will pull in the messenger line 134 (FIG. 1) while the powered drill line spooler 14 pays out drill line 136 until the drill line 136 is completely strung between the crown block 112 and the traveling block 114.

As illustrated in FIG. 3, a driller side elevation of the well drilling apparatus 1 in accordance with one embodiment of the present invention wherein its mast 30 (FIG. 2) and drill floor 42 are in a position between its horizontal field assembly position and its vertical operating position. Once the well drilling apparatus 1 is fully assembled at ground level and the dog tail 70*a* is raised and fixed in its vertical position, the dog tail spooler 20*a* is wound so that the dog tail line 130*a* wraps itself around the dog tail spooler 20*a*. As a result of the wrapping and the anchoring of the dog tail line 130*a*, the dog tail 70*a* pivotally moves back towards its horizontal position, while simultaneously causing the mast 30 (FIG. 2) to pivotally rise to its vertical operating position.

As the mast 30 (FIG. 2) rises to its vertical position, the mast starter section's 40*a* front leg 64*a* pivots around the front leg mount 66*a*, which slowly brings the mast starter section's 40*a* rear leg 58*a* closer to the rear leg mount 60*a*. Once the mast 30 (FIG. 2) is positioned in its vertical operating position and the dog tail 70*a* is back in its initial horizontal position, the mast starter section's 40*a* rear leg 58*a* is seated properly in the rear leg mount 60*a*. A rear leg pin 62*a* is then inserted in the rear leg mount 60*a* so that the mast 30 (FIG. 2) is securely positioned.

The entire elevatable drill floor 42 is coupled together with the mast starter section 40*a* as a parallelogram and is raised to its proper horizontal operating elevation at the same time the mast 30 (FIG. 2) is raised to its vertical position. Throughout the entire mast raising process, the elevatable drill floor 42 continuously remains in a horizontal position, thereby allowing equipment to be laid out on top of the elevatable drill floor 42 and be raised with it during assembly. This reduces manpower time and equipment needed for assembly. The supporting leg 50*a* pivots around both the supporting leg mount 54*a* and the attachment point with the elevatable drill floor 42. The elevatable drill floor 42 also pivots around its attachment point with the mast starter section's 40*a* front leg 64*a*. Thus, these pivoting locations allow the elevatable drill floor 42 to remain in a substantially horizontal position while the mast 30 (FIG. 2) is being raised or lowered.

Figure 4:
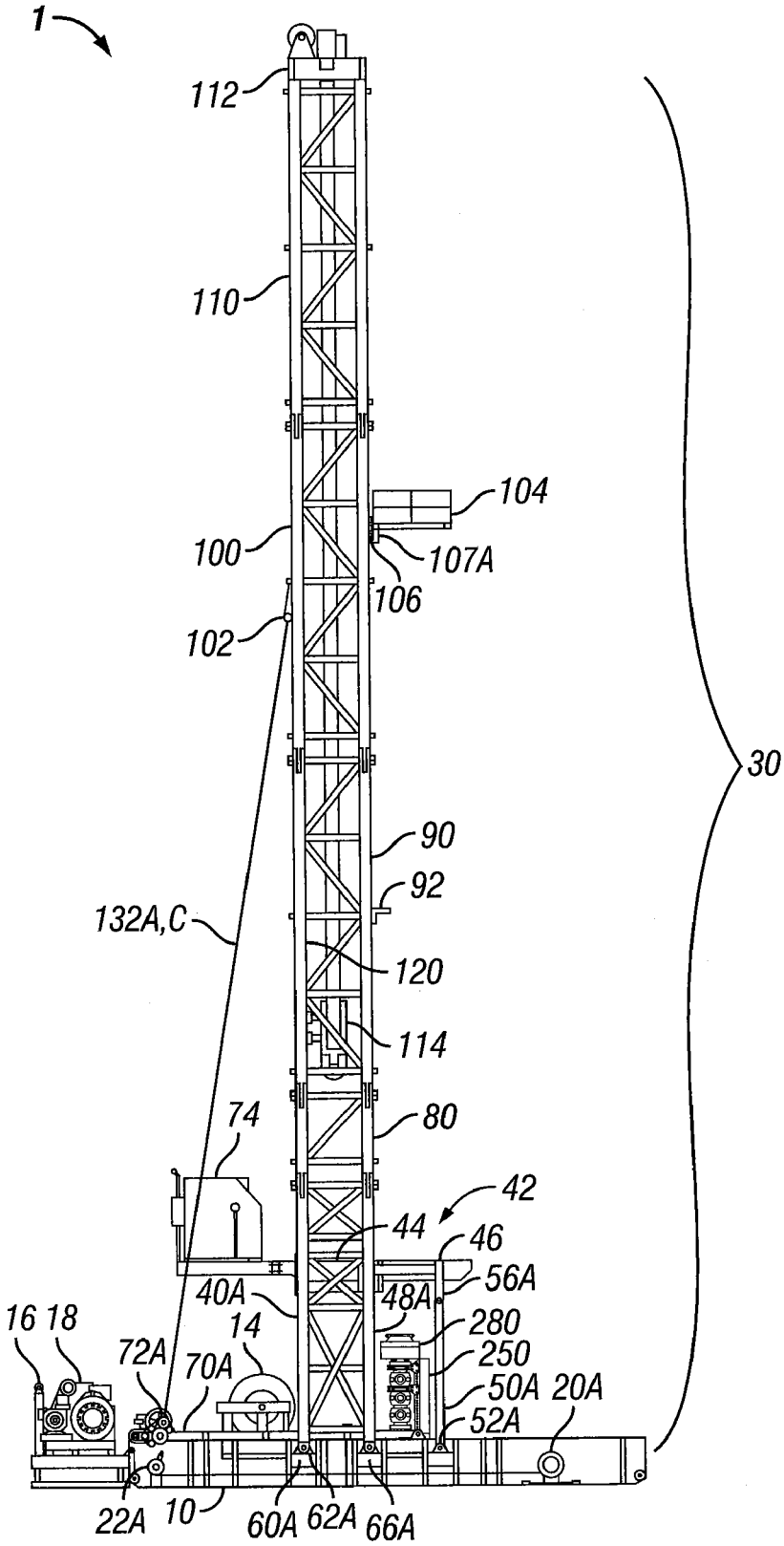
FIG. 4 illustrates a driller side elevation of the well drilling apparatus in accordance with one embodiment of the present invention wherein its mast is in its vertical operating position.
Figure 4B:
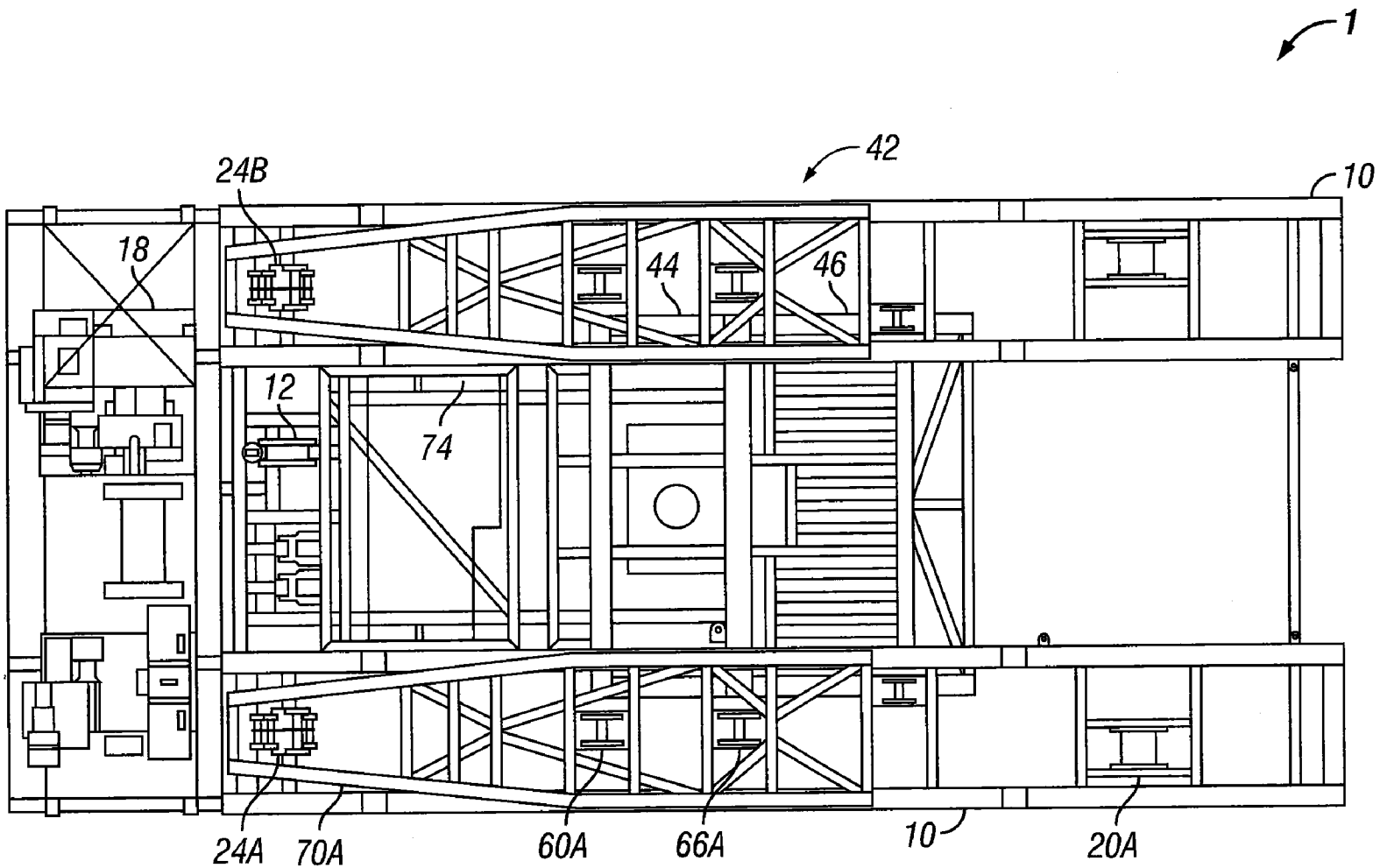
FIG. 4B illustrates an overhead plan view of the well drilling apparatus in accordance with one embodiment of the present invention wherein its mast is in its vertical operating position.

FIG. 4 illustrates a driller side elevation of the well drilling apparatus 1 in accordance with one embodiment of the present invention wherein its mast 30 is in its vertical operating position. FIG. 4*p* shows an overhead plan view of the well drilling apparatus 1 shown in FIG. 4 and should be viewed in conjunction with FIG. 4. Once the mast 30 is in its vertical operating position, the rear leg pin 62*a*, as mentioned previously, and a rear leg drill floor pin 47*a* are installed so that the well drilling apparatus 1 becomes operationally sturdy. The racking board 104 is also securely fastened to the mast intermediate section 100 via a racking board pin 106 so as to prevent further pivoting.

Figure 5:
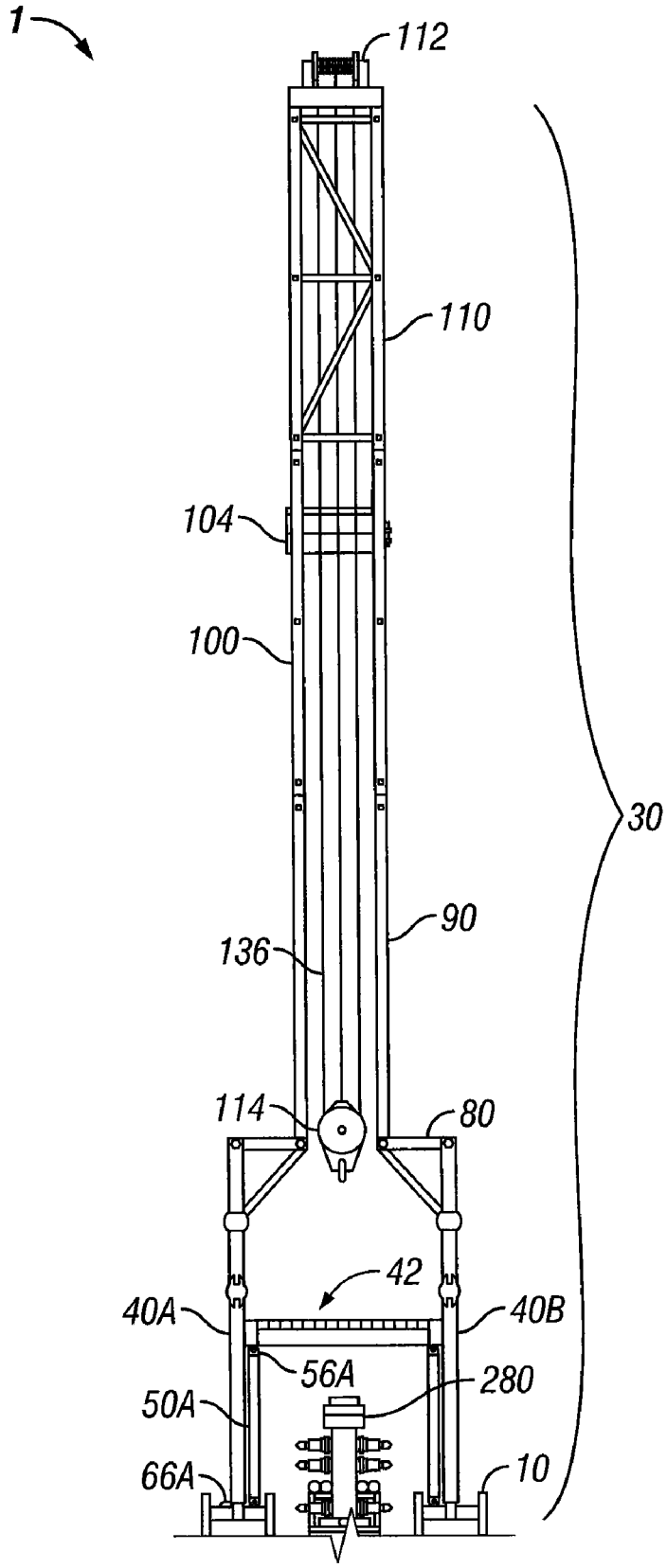
FIG. 5 illustrates a front schematic view of the well drilling apparatus in accordance with one embodiment of the present invention in its fully erected and operating position.

FIG. 5 illustrates a front schematic view of the well drilling apparatus 1 in accordance with one embodiment of the present invention in its fully erected and operating position. This figure more clearly illustrates a front profile view of the crown block 112, the mast 30, the racking board 104, the traveling block 114, the elevatable drill floor 42, the mast starter sections 40*a*, 40*b*, and a blow-out preventer 280. The blow-out preventer 280 is required to be placed on the wellhead before drilling commences. It can be seen that the well drilling apparatus 1 can be lowered and disassembled into its several pre-assembled pieces without interfering with the installed blow-out preventer 280.

The procedure for installing the blow-out preventer 280 can be readily seen in FIGS. 6-9. A blow-out preventer handling and transporting device 200 comprises a trolley 220 that is movably connected to a skid 210. The trolley 220 is a component of the modular system and serves as a shipping support for the blow-out preventer 280. A control panel 230, located on the skid 210, is in communication with the trolley 220 so that the trolley 220 may move in a front-rear direction with respect to the skid 210. A hydraulic arm 240*a* is pivotally attached to the trolley 220 at a trolley mount 225*a* at one end and is pivotally attached to a blow-out preventer base 250 at a blow-out preventer base mount 255*a*. The hydraulic arm 240*a* is used for lowering and raising the blow-out preventer base 250. The blow-out preventer 280 is removably attached to the blow-out preventer base 250 via brackets 260 and pins (not shown). Although this embodiment shows three brackets 260, each having three pins, bolts, or screws, one skilled in the art will recognize that more or less brackets may be used with each having more or less pins, bolts or screws without departing from the scope and spirit of the present invention.

Figure 6:
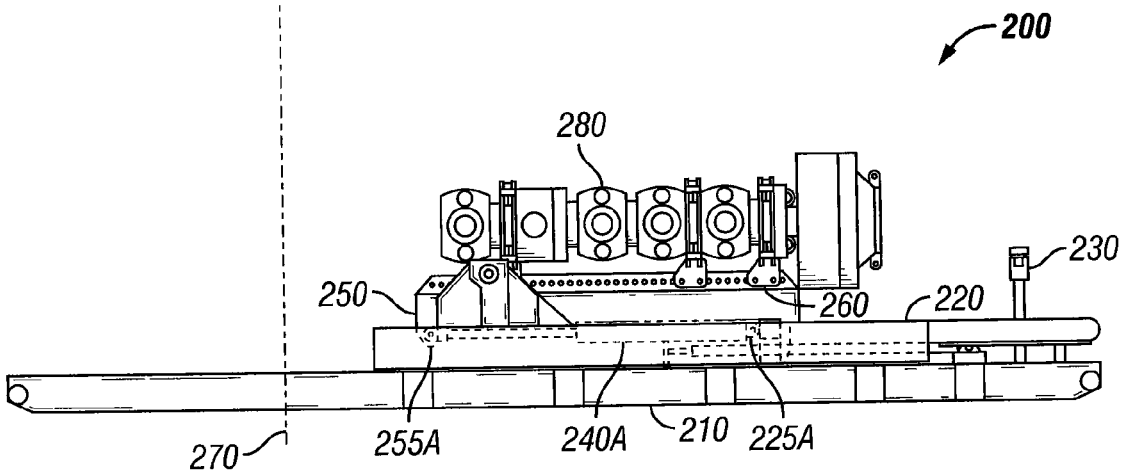
FIG. 6 illustrates a driller side elevation of a blow-out preventer handling and transporting device in accordance with one embodiment of the present invention.

FIG. 6 illustrates a side elevation of a blow-out preventer handling and transporting device 200 that is positioned appropriately in accordance with one embodiment of the present invention. To install the blow-out preventer 280, the skid 210 and trolley 220 are first appropriately positioned above a well's centerline 270, such that the well's centerline 270 passes through the skid 210 but not through the trolley 220.

Figure 7:
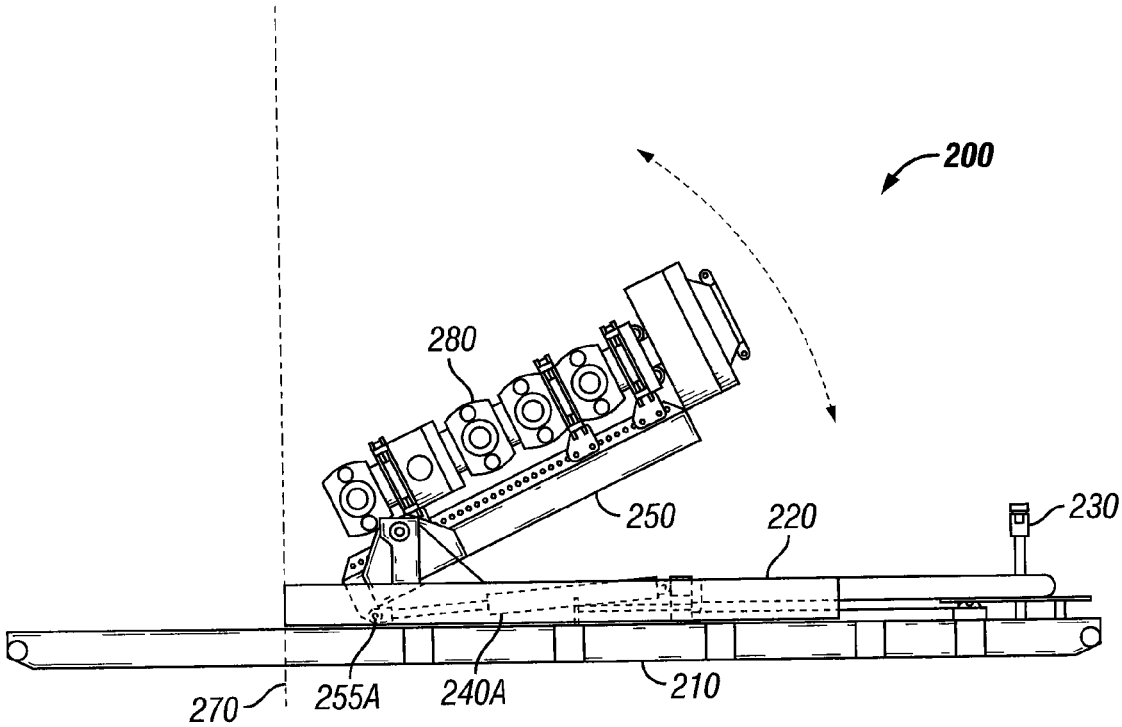
FIG. 7 illustrates a driller side elevation of the blow-out preventer handling and transporting device in accordance with one embodiment of the present invention wherein a blow-out preventer is in a position between its horizontal position and its vertical operating position.

FIG. 7 illustrates a side elevation of the blow-out preventer handling and transporting device 200 in accordance with one embodiment of the present invention wherein the blow-out preventer 280 is in a position between its horizontal position and its vertical operating position. As illustrated in this figure, the control panel 230 positions the trolley's 220 rear edge to align directly above the well's centerline 270. This positioning allows for the blow-out preventer's 280 centerline to be aligned with the well's centerline 270 once the blow-out preventer 280 is raised to its vertical operating position. Once the skid 210 and trolley 220 are appropriately positioned, the control panel 230 lowers the hydraulic arm 240*a* and then raises the blow-out preventer base 250. The blow-out preventer base 250 is pivoted hydraulically around the blow-out preventer base mount 255*a* until it reaches a vertical position.

Figure 8:
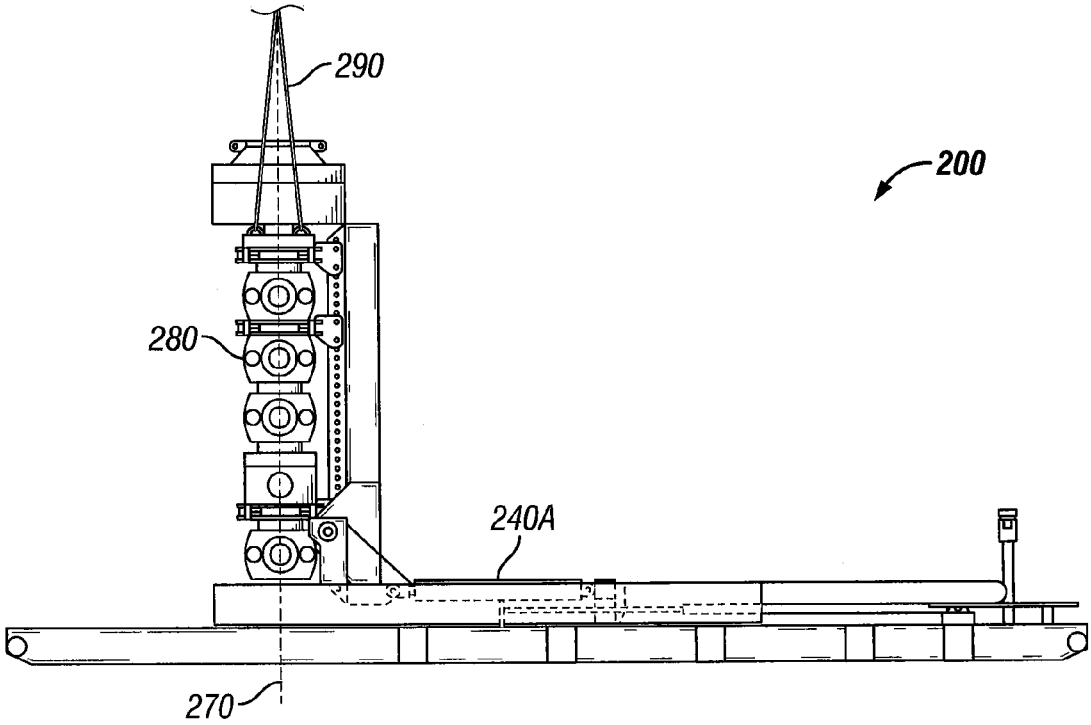
FIG. 8 illustrates a driller side elevation of the blow-out preventer handling and transporting device in accordance with one embodiment of the present invention wherein the blow-out preventer is in its vertical operating position.

FIG. 8 illustrates a side elevation of the blow-out preventer handling and transporting device 200 in accordance with one embodiment of the present invention wherein the blow-out preventer 280 is in its vertical operating position. Once the blow-out preventer 280 has been raised to its vertical position, the hydraulic arm 240*a* is raised back to its horizontal position, thereby lifting the blow-out preventer 280. The traveling block 114 (FIG. 5) is then lowered and connected to the blow-out preventer 280 via three supporting lines 290. Although this embodiment depicts three supporting lines 290, one skilled in the art will recognize that more or less supporting lines may be used without departing from the scope and spirit of the present invention.

Figure 9:
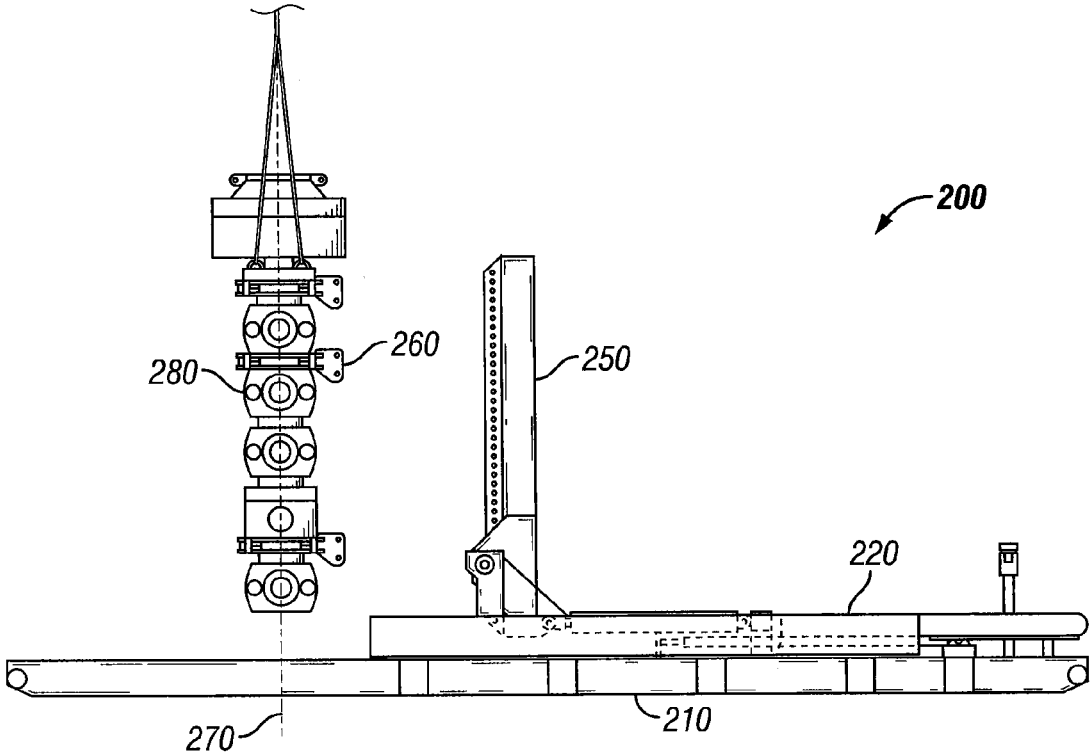
FIG. 9 illustrates a driller side elevation of the blow-out preventer handling and transporting device in accordance with one embodiment of the present invention wherein the blow-out preventer is lifted by a traveling block.

FIG. 9 illustrates a side elevation of the blow-out preventer handling and transporting device 200 in accordance with one embodiment of the present invention wherein the blow-out preventer 280 is lifted by the traveling block 114 (FIG. 5). Once the traveling block 114 (FIG. 5) is securely fastened to the blow-out preventer 280, the brackets 260 are unfastened from the blow-out preventer base 250. The traveling block 114 (FIG. 5) then lifts the blow-out preventer 280 so that the skid 210 and trolley 220 may be moved away. Finally, the traveling block 114 (FIG. 5) lowers the blow-out preventer 280 onto the well's centerline 270 so that it can be properly installed.

In an alternative embodiment (not shown), a different method, other than utilizing the dog tail spooler, may be used to raise and lower the dog tail, which results in raising and lowering the mast. The first dog tail sheave, the second dog tail sheave and the dog tail are still used in the same manner as described in the previous embodiment. This alternative embodiment utilizes a hydraulic cylinder, a hydraulic arm and a transitional pulling sheave, in lieu of the dog tail spooler. The hydraulic cylinder is attached horizontally along the front portion of the substructure. The hydraulic arm is located partially within the hydraulic cylinder and movably extends toward the first dog tail sheave. The transitional pulling sheave is securely attached to the hydraulic arm's end, which is closer to the first dog tail sheave. In this alternative embodiment, the dog tail line is wrapped around the transitional pulling sheave, the first dog tail sheave and the second dog tail sheave. Here, when the hydraulic cylinder pushes the hydraulic arm towards the first dog tail sheave, more dog tail line is available between the first dog tail sheave and the second dog tail sheave, thus causing the dog tail to rise and the mast to lower. However, when the hydraulic cylinder pulls the hydraulic arm away from the first dog tail sheave, less dog tail line is available between the first dog tail sheave and the second dog tail sheave, thus causing the dog tail to lower and the mast to rise.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. It is therefore, contemplated that the claims will cover any such modifications or embodiments that fall within the true scope of the invention.

What is claimed is:

1. A well drilling apparatus comprising:

a pre-assembled transportable substructure having a rear end and a front end, and also having at least two front leg mounts, at least two rear leg mounts and at least two support leg mounts, wherein the substructure further comprises:

a mast starter section, located at the front end of the substructure, having at least two front legs and at least two rear legs, wherein the at least two front legs are pivotally attached to the at least two front leg mounts;

at least two supporting legs pivotally attached to the at least two support leg mounts at one end;

an elevatable drill floor pivotally attached to the second end of the at least two supporting legs and wherein the elevatable drill floor is also pivotally attached to the at least two front legs of the mast starter section;

at least one dog tail pivotally attached to the substructure, wherein the at least one dog tail is adapted for raising a mast assembly from its horizontal assembly position to its vertical operating position; and a mast assembly raising system that communicates forces between the substructure, the at least one dog tail and the mast assembly, wherein the mast assembly raising system can raise the mast assembly to its vertical operating position by having the at least two front legs of the mast starter section pivot around the at least two front leg mounts and thereby causing the at least two rear legs of the mast starter section to attach itself to the at least two rear leg mounts;

a pre-assembled mast strong back, wherein the mast strong back is connected to the mast starter section at ground level without a crane, thereby forming a part of the mast assembly;

at least one pre-assembled transportable mast intermediate section, wherein the at least one mast intermediate section is connected to the mast strong back at ground level without a crane, thereby forming a part of the mast assembly;

a pre-assembled transportable mast top section having a crown block in communication with a traveling block via a messenger line, wherein the mast top section is assembled at the top of the at least one mast intermediate section at ground level without a crane, thereby forming the rest of the mast assembly; and a second anchor point, located along the length of the mast assembly, for providing communication from the mast assembly raising system to the mast assembly.

2. The apparatus of claim 1, wherein the second anchor point is located on the at least one mast intermediate section.

3. The apparatus of claim 1, wherein the second anchor point is located on the mast top section.

4. The apparatus of claim 1, wherein the substructure further comprises a removable drawworks assembly, located at the rear end of the substructure, for operating the traveling block within the mast assembly, and the removable drawworks assembly remains at the rear end of the substructure when the elevatable drill floor is elevated.

5. The apparatus of claim 1, wherein the elevatable drill floor comprises a rotary drill floor and a setback drill floor.

6. The apparatus of claim 1, wherein the elevatable drill floor further comprises a dog house and driller console.

7. The apparatus of claim 1, wherein the elevatable drill floor remains at a substantially horizontal position throughout the raising and lowering of the mast assembly and the mast starter section.

8. The apparatus of claim 1, wherein the mast assembly raising system comprises:

at least one dog tail spooler located near the front end of the substructure;

at least one first dog tail sheave located near the rear end of the substructure;

at least one second dog tail sheave located at the top end of the at least one dog tail;

a first anchor point located at the top end of the at least one dog tail;

at least one dog tail line connecting the at least one dog tail spooler to the at least one second dog tail sheave via the at least one first dog tail sheave; and at least one sling line securely connecting the first anchor point to the second anchor point.

9. The apparatus of claim 1, wherein the mast assembly raising system comprises:

at least one hydraulic cylinder, wherein the at least one hydraulic cylinder has a hydraulic arm that is movable within the at least one hydraulic cylinder and a transitional pulling sheave located at the top of the hydraulic arm, wherein the at least one hydraulic cylinder is positioned horizontally along the front end of the substructure and extends toward the rear end of the substructure;

at least one first dog tail sheave located near the rear end of the substructure;

at least one second dog tail sheave located at the top end of the at least one dog tail;

a first anchor point located at the top end of the at least one dog tail;

at least one dog tail line connecting the at least one transitional pulling sheave to the at least one second dog tail sheave via the at least one first dog tail sheave; and at least one sling line securely connecting the first anchor point to the second anchor point.

10. The apparatus of claim 1, wherein the at least one mast intermediate section and the mast top section have built-in guide rails.

11. A well drilling apparatus comprising:

a pre-assembled transportable substructure having a rear end and a front end, and also having two front leg mounts, two rear leg mounts and two support leg mounts, wherein the substructure further comprises:

a mast starter section, located at the front end of the substructure, having two front legs and two rear legs, wherein the two front legs are pivotally attached to the two front leg mounts;

two supporting legs pivotally attached to the two support leg mounts at one end;

an elevatable drill floor pivotally attached to the second end of the two supporting legs and wherein the elevatable drill floor is also pivotally attached to the two front legs of the mast starter section;

two dog tails pivotally attached to the substructure, wherein the two dog tails are adapted for raising a mast assembly from its horizontal assembly position to its vertical operating position; and a mast assembly raising system that communicates forces between the substructure, the two dog tails and the mast assembly, wherein the mast assembly raising system can raise the mast assembly to its vertical operating position by having the two front legs of the mast starter section pivot around the two front leg mounts and thereby causing the two rear legs of the mast starter section to attach itself to the two rear leg mounts;

a pre-assembled mast strong back, wherein the mast strong back is connected to the mast starter section at ground level without a crane, thereby forming a part of the mast assembly;

a plurality of pre-assembled transportable mast intermediate sections, wherein one of the plurality of mast intermediate sections is connected to the mast strong back at ground level without a crane, and wherein the remaining mast intermediate sections are connected to the other mast intermediate sections at ground level without the crane, thereby forming a part of the mast assembly;

a pre-assembled transportable mast top section having a crown block in communication with a traveling block via a messenger line, wherein the mast top section is assembled at the top of the plurality of mast intermediate sections at ground level without a crane, thereby forming the rest of the mast assembly; and a second anchor point, located along the length of the mast assembly, for providing communication from the mast assembly raising system to the mast assembly.

12. The apparatus of claim 11, wherein the second anchor point is located on one of the plurality of mast intermediate sections.

13. The apparatus of claim 11, wherein the second anchor point is located on the mast top section.

14. The apparatus of claim 11, wherein the substructure further comprises a removable drawworks assembly, located at the rear end of the substructure, for operating the traveling block within the mast assembly, and the removable drawworks assembly remains at the rear end of the substructure when the elevatable drill floor is elevated.

15. The apparatus of claim 11, wherein the elevatable drill floor comprises a rotary drill floor and a setback drill floor.

16. The apparatus of claim 11, wherein the elevatable drill floor further comprises a dog house and driller console.

17. The apparatus of claim 11, wherein the elevatable drill floor remains at a substantially horizontal position throughout the raising and lowering of the mast assemble and the mast starter section.

18. The apparatus of claim 11, wherein the mast assembly raising system comprises:

two dog tail spoolers located near the front end of the substructure;

two first dog tail sheaves located near the rear end of the substructure;

two second dog tail sheaves located at the top end of each of the two dog tails;

a first anchor point located at the top end of each of the two dog tails;

two dog tail lines connecting the two dog tail spoolers to the two second dog tail sheaves via the two first dog tail sheaves; and at least one sling line securely connecting the first anchor point to the second anchor point.

19. The apparatus of claim 11, wherein the mast assembly raising system comprises:

two hydraulic cylinders, wherein each of the two hydraulic cylinders has a hydraulic arm that is movable within the hydraulic cylinder and a transitional pulling sheave located at the top of the hydraulic arm, wherein the two hydraulic cylinders are positioned horizontally along the front end of the substructure and extends toward the rear end of the substructure;

two first dog tail sheaves located near the rear end of the substructure;

two second dog tail sheaves located at the top end of each of the two dog tails;

a first anchor point located at the top end of each of the two dog tails;

two dog tail lines connecting the two transitional pulling sheaves to the two second dog tail sheaves via the two first dog tail sheaves; and at least one sling line securely connecting the first anchor point to the second anchor point.

20. The apparatus of claim 11, wherein the mast intermediate sections and the mast top section have built-in guide rails.

21. A method of erecting a well drilling apparatus having a pre-assembled transportable substructure with a front end and a rear end, which includes an elevatable drill floor, at least one dog tail, a mast assembly raising system which connects the substructure to the at least one dog tail, and a mast starter section, wherein the elevatable drill floor, the at least one dog tail, and the mast starter section are initially positioned in its horizontal assembled position, at least one pre-assembled transportable mast intermediate section and a pre-assembled transportable mast top section mast strong back comprising the steps of:

assembling the mast strong back horizontally to the top of the mast starter section while at ground level;

assembling the at least one mast intermediate section horizontally to the top of the mast strong back while at ground level;

assembling the mast top section horizontally to the top of the at least one mast intermediate section;

raising the at least one dog tail to a vertical position;

securing one end of at least one sling line to the top of the dog tail and the second end to the intermediate mast section;

activating the mast assembly raising system so that the at least one dog tail is lowered back towards its initial horizontal position while simultaneously raising the mast via the at least one sling line and simultaneously raising the elevatable floor to its operating position, wherein the elevatable floor continuously remains at its substantially horizontal position throughout the raising process, and wherein at least one front leg of the mast starter section pivots about at least one front leg mount, located within the substructure, thereby having at least one rear leg of the mast starter section attach to at least one rear leg mount, located within the substructure; and stabilizing the well drilling apparatus once it is in its fully vertical operating position.

22. The method of claim 21, wherein the mast assembly raising system comprises:

at least one dog tail spooler located near the front end of the substructure;

at least one first dog tail sheave located near the rear end of the substructure;

at least one second dog tail sheave located at the top end of the at least one dog tail; and at least one dog tail line connecting the at least one dog tail spooler to the at least one second dog tail sheave via the at least one first dog tail sheave.

23. The method of claim 21, wherein the mast assembly raising system comprises:

at least one hydraulic cylinder, wherein the at least one hydraulic cylinder has a hydraulic arm that is movable within the at least one hydraulic cylinder and a transitional pulling sheave located at the top of the hydraulic arm, wherein the at least one hydraulic cylinder is positioned horizontally along the front end of the substructure and extends toward the rear end of the substructure;

at least one first dog tail sheave located near the rear end of the substructure;

at least one second dog tail sheave located at the top end of the at least one dog tail; and at least one dog tail line connecting the at least one transitional pulling sheave to the at least one second dog tail sheave via the at least one first dog tail sheave.

* * * * *